US005551491A

United States Patent [19]

Baruffato et al.

[11] Patent Number: 5,551,491

[45] Date of Patent: Sep. 3, 1996

[54] AUTOMATIC CAROUSEL MACHINE FOR THE METERED FEEDING AND PACKAGING OF FLUID PRODUCTS

[75] Inventors: Roberto Baruffato, San Lazzaro Di Savena; Claudio Trebbi, Medicina; Claudio Barbieri; William Vigna, both of Bologna, all of Italy

[73] Assignee: I.M.A. Industria Macchine Automatiche S.p.A., Ozzano Emila, Italy

[21] Appl. No.: 264,353

[22] Filed: Jun. 22, 1994

[30] Foreign Application Priority Data

Jul. 1, 1993 [IT] Italy ..... BO93A0310

[51] Int. Cl.[6] ..... B65B 43/42

[52] U.S. Cl. ..... 141/145; 141/119; 141/238; 141/145

[58] Field of Search ..... 141/144, 145, 141/146, 147, 148, 149, 150, 119, 238, 85

[56] References Cited

U.S. PATENT DOCUMENTS

| | | | |
|---|---|---|---|
| 1,770,470 | 7/1930 | Hartmann | 141/145 |
| 2,665,046 | 1/1954 | Rogers et al. | 141/147 |
| 2,805,688 | 9/1957 | Rowekamp | 141/119 |
| 2,827,208 | 3/1958 | Keller | 141/148 |
| 3,419,053 | 12/1968 | Tanner | 141/145 |
| 4,349,053 | 9/1982 | Eisenberg | 141/1 |
| 4,884,599 | 12/1989 | Newman et al. | 141/1 |
| 4,949,766 | 8/1990 | Coatsworth | 141/145 |

FOREIGN PATENT DOCUMENTS

| | | |
|---|---|---|
| 657427 | 7/1928 | France . |
| 3024271 | 1/1981 | Germany . |

*Primary Examiner*—Henry J. Recla
*Assistant Examiner*—Steven O. Douglas
*Attorney, Agent, or Firm*—Larson and Taylor

[57] ABSTRACT

The feeders for forming portions of the product, the product supply reservoir and the valves which switch the connection of the feeders between the reservoir and the feed nozzles located on the feeding and packaging carousel are separate from the carousel itself and are mounted in any position in which they can be easily inspected, and the feeders are connected to the nozzles by means of the fixed part of at least one rotary joint disposed coaxially on the carousel. This joint is characterized by high reliability in operation, is designed to facilitate washing and sterilization of all the circuits through which the product flows, and if necessary can be easily dismantled for inspection of the various components. The rotary joint may be designed to form distribution chambers for the monitoring of the residual product in the nozzles during the inoperative transit of these components and/or for the monitoring of a flow of any sanitizing gas which the nozzles are required to blow into the containers at the filling stage.

13 Claims, 7 Drawing Sheets

AUTOMATIC CAROUSEL MACHINE FOR THE METERED FEEDING AND PACKAGING OF FLUID PRODUCTS

BACKGROUND AND SUMMARY OF THE INVENTION

The invention relates to automatic machines for the metered feeding and packaging in bottles, flacons or other containers of fluid products in general and in particular liquid or cream products, for pharmaceutical, cosmetic, food, or other use.

Known high-output machines are normally of the carousel type and have at each operating point a metered volume feeder which is alternately connected to the product supply reservoir and to the nozzle which discharges the portion into the packaging containers. These machines are remarkably bulky and complex in construction and therefore present maintenance problems due to the difficulty of access to the many components installed in the machines. Owing to the considerable quantity of the various components, the stages of washing and sterilization of the machine require relatively long periods, the more so because of the necessity of thermally treating the said components.

In order to partially avoid these disadvantages, carousel or transfer machines have been devised, with a limited number of metered volume feeders which operate in sequence, with an alternating movement, while the containers to be filled advance with a continuous movement. These machines, which are less complex and less bulky than the former type, still have the disadvantage of disturbing, with the alternating movement of the feeders, the flow of sterile air which is normally created in the environment in which the machine operates when the products to be packaged require this condition. Moreover, even if the feeding stations are operated with appropriate acceleration and deceleration, the latter machines are markedly slower than the former and give rise to vibrations which, inter alia, may cause the product to drip from the feed nozzles.

The invention is intended to avoid these and other disadvantages with the following idea for a solution. Within a high-output automatic machine of the carousel type, the feeders, present in the proportion of one for each operating point of the carousel, or in another appropriate quantity, are arranged outside the carousel, together with the supply reservoir of the product to be fed, and, with the interposition of suitable valve means, the same feeders can be connected alternately to the said reservoir and to the product feed nozzles of the operating points of the carousel, this last connection being made by means of a rotary joint which is disposed on the carousel itself, coaxially with the carousel, and is characterized by high reliability in operation.

In a possible extension of this solution, the rotary joint may be designed to form distribution chambers which, on completion of the discharge of the portion of product into the container, interrupt the connection of each nozzle to the corresponding metered volume feeder which can switch to a connection to the reservoir for the formation of a subsequent portion of product, while the isolated nozzles can be temporarily connected to a suction source which retains the residual product in them and avoids dripping. The selective connection of auxiliary longitudinal channels of the product feed nozzles to a sanitizing gas source can be provided through suitable channels made in the rotary joint.

The machine made according to the principles stated above is of simplified construction, permits operation in an undisturbed flow of sterile air, and makes it possible to have the feeders with their switching valves and the product supply reservoir in a position remote from the carousel for packaging the portions of product, and enables these components to be reached rapidly and conveniently for all maintenance requirements.

BRIEF DESCRIPTION OF THE DRAWINGS

Further characteristics of the invention, and the advantages derived therefrom, will be apparent from the following description of some preferred embodiments of the invention, swown in the annexed drawings, in which.

DESCRIPTION OF THE PREFERRED EMBODIMENT OF THE INVENTION

Figure 4:
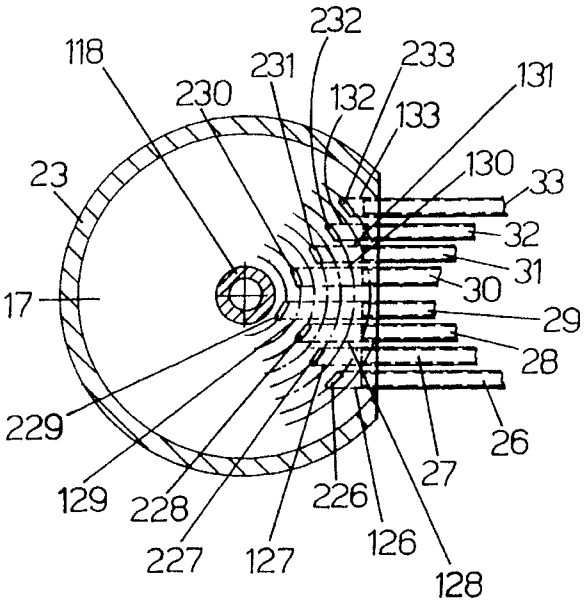
FIGS. 4 and 5 show details of the machine taken along the section lines IV—IV and V—V of FIG. 3.

With reference to FIGS. 1-2-3-4-5, it will be seen that the machine comprises a vertical turret 1 which, by suitable means, is caused to rotate continuously in the direction indicated for example by the arrow F, and that a disc 2 of any suitable material for the formation of a rotary joint, for example a ceramic material, is fixed to the turret. The disc 2 is surrounded by a metal ring 3 integral with the said disc and having a plurality of external and angularly equidistant radial collars 4 which form sockets of a known type, with rapid bayoneted fittings, for nozzles 5 directed downwards and used for feeding the portions of product. Carousel devices of any suitable known type, which are consequently not illustrated, operate in phase and integrally with the turret 1 (see FIG. 1 ) and pick up the empty containers 6 from a supply line 7, place a container tinder each nozzle, raise the container during the filling stage, lower it at the end of this stage, and then transfer each filled con Gainer to an output line 8.

Figure 2:
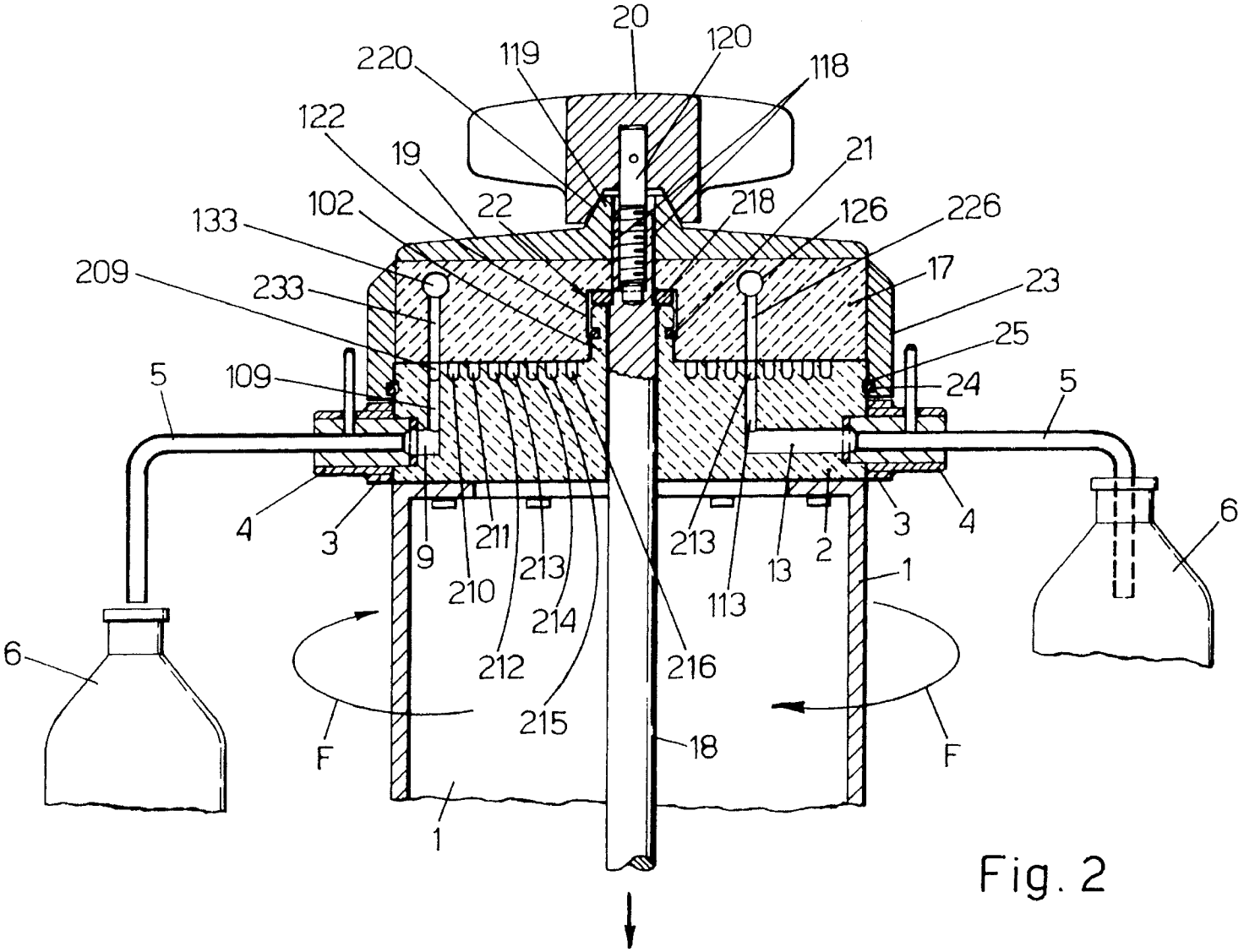
FIG. 2 is a longitudinal cross section taken along the line II—II of FIG. 1, of a detail of the machine according to the invention.
Figure 5:
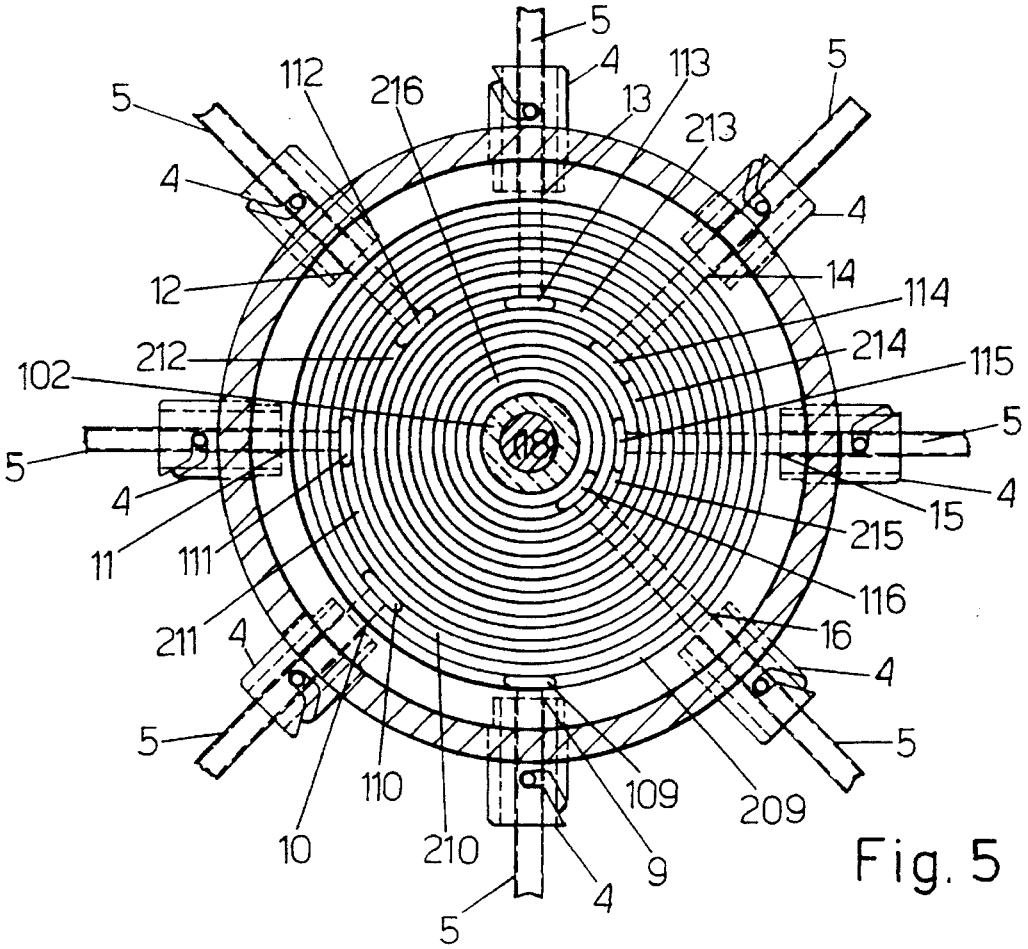

In FIGS. 2 and 5 it will be seen that the nozzles 5 are connected to corresponding holes 9-10-11-12-13-14-15-16 formed radially in the disc 2, of varying lengths, and connected through corresponding vertical end holes 109-110-111-112-113-114-115-116 to corresponding concentric annular channels 209-210-211-212-213-214-215-216 formed with precise spacing from each other on the upper face of the disc 2 and having their centers in the axis of this disc.

A disc 17 of suitable material, for example, once again, a ceramic material, bears on the disc 2 with a frontal seal and is keyed axially to a shaft 18 connected to means which prevent its rotation, keep it pressed downwards and, when commanded, can raise it through a precise distance (see below). The shaft 18 has a tapered upper end part 118, which passes through the stop ring 218, an axial hole in the disc 17, and the central conical part 119 of a cover 19 integral with the said disc. The section of shaft 118 is provided with an axial threaded socket into which can be screwed the screw 120 of a knob 20 which, by its conical socket 220, is fitted on the projection 119 of the cover and holds the assembly 17-18-19-20 together.

The disc 2 has an axial cylindrical projection of round section 102, with an outer seal 21, and this projection is housed rotatably in an axial socket 22 of the fixed disc 17, which is provided with an enlarged upper section 122, so that, when the discs 2 and 17 are in contact with each other as in FIG. 2, the said seal 21 does not touch parts of the rotating disc 2. The disc 17 has a laterally attached annular body 23 which projects for a precise distance below the said disc, which rotatably surrounds the disc 2 and which is provided with an annular groove with a seal 24 next to the disc 2. When the discs 2 and 17 are in contact with each other, as in FIG. 2, the disc 2 has an outer annular recess 25 next to the seal 24 which therefore does not bear on rotating parts.

Figure 3:
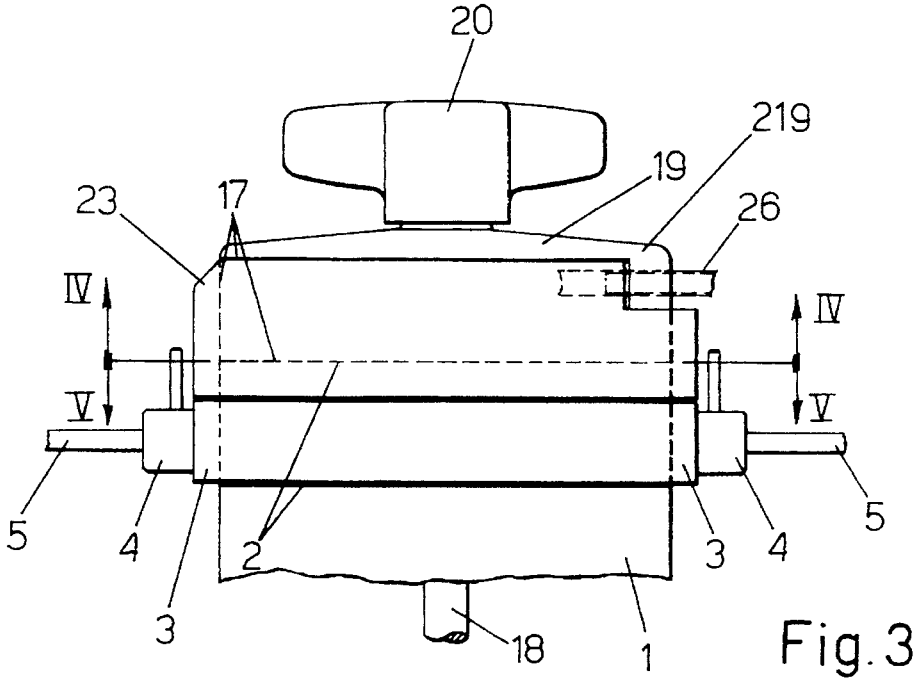
FIG. 3 is a partial side elevation of the machine.

From FIGS. 3 and 4 it will be seen that the cover 19 has, on its perimeter, an integral downward extension 219 which engages with a corresponding slot in the body 23 and which meets the ends of ducts 26-27-28-29-30-31-32-33 which communicate with corresponding horizontal holes 126-127-128 -129-130-131-132-133 which are provided in the fixed disc 17 and which in turn have their ends connected to corresponding descending holes 226-227-228-229-230-231-232-233, each of which opens above one of the concentric annular channels 209-210-211-212-213-214-215-216 in the rotating disc 2.

Figure 1:
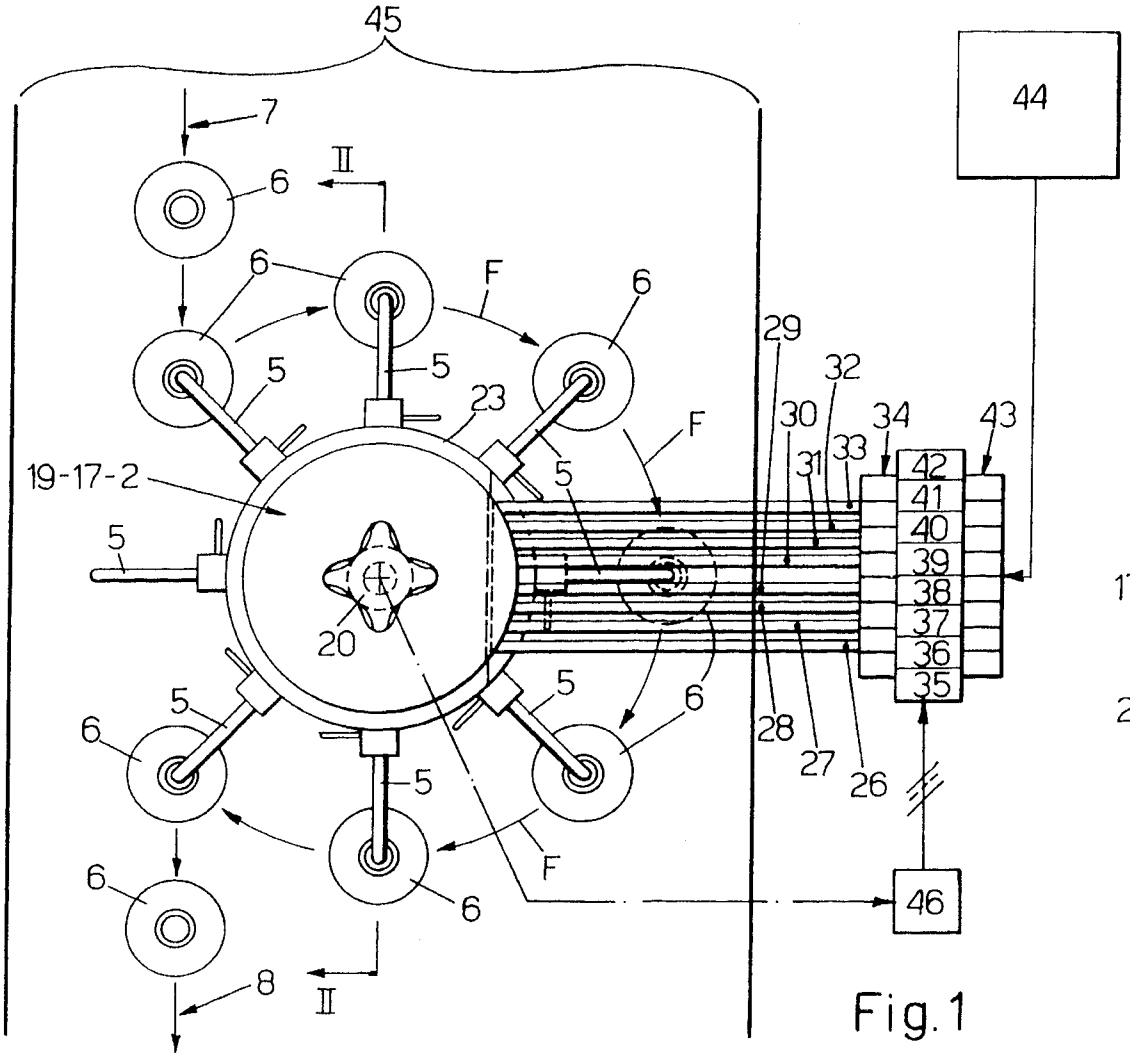
FIG. 1 is a digrammatic plan view of the machine.

From FIG. 1 it will be seen that the previously mentioned ducts 26 to 33 are connected, with the interposition on of corresponding valve means indicated as a whole by 34, to corresponding metered volume feeders 35-36-37-38-39-40-41-42 which, with the interposition of other valve means indicated as a whole by 43, can be connected to the supply reservoir 44 of the product to be fed and packaged. The assembly of parts 34 to 44 can be located outside the environment 45 in which the machine according to the invention operates and in which known means can maintain a controlled and sterile atmosphere. It is to be understood that the feeders and the valve means can be disposed in any suitable way, not necessarily in line as shown in FIG. 1, but, for example, on a circumference, for driving by means of a barrel cam which is brought into synchronized rotation with the turret 1.

Operation of the Described Embodiment

The operation of the machine designed in this way is simple and evident. By the use of means 46 which can be easily made by persons skilled in the art, and which can operate in phase with the angular displacement of each nozzle 5, the metered volume feeders and the corresponding valve means 34–43 are selectively arranged for the suction of a portion of product from the reservoir 44 when a container 6 moves away from a nozzle and the nozzle is moved to interact with a subsequent container, and are arranged for discharge of the portion of product into the container through the rotary joint formed by the discs 2 and 17, when each nozzle passes through that section of the carousel in which the container 6 is raised and engaged by the corresponding nozzle. The appropriate end configuration of the nozzles 5, which creates capillary retention effects, a siphon configuration of the nozzles if required, a brief connection of the nozzles with the feeders in the suction stage before their removal from the feeders, and other solutions known in the field of feeders, will be provided to avoid the dripping of product from the nozzles when the full containers move away from them and the nozzles move towards the next empty container.

Figure 6:
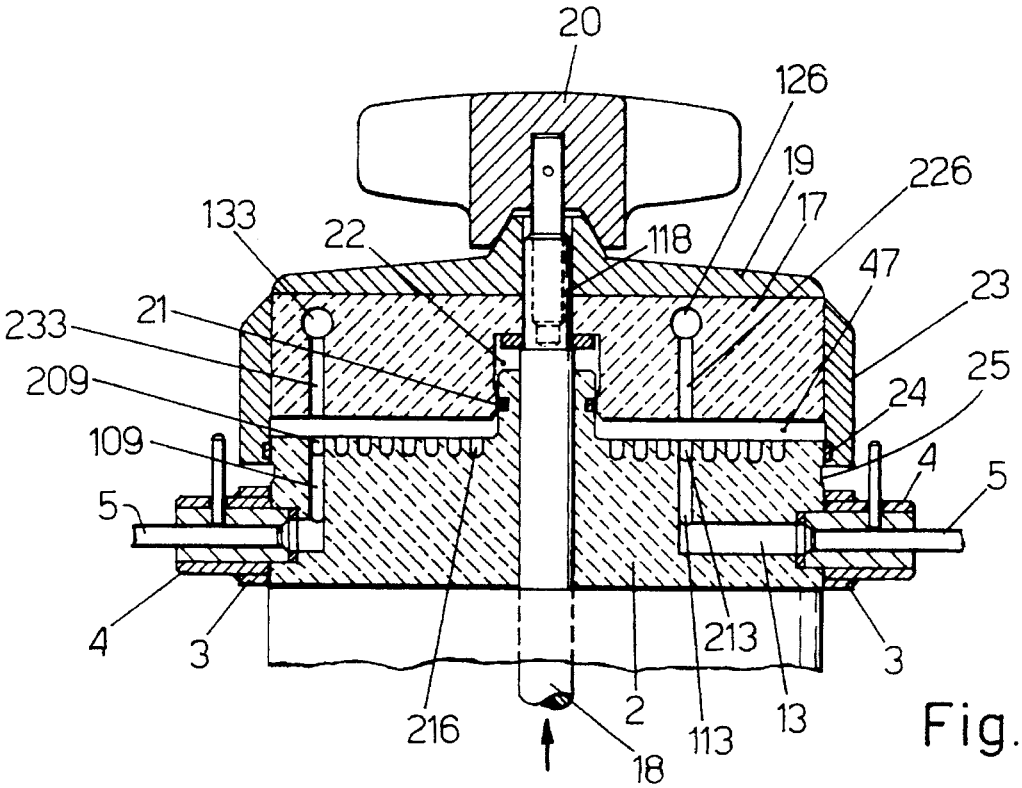
FIG. 6 is a view of the machine similar to that of FIG. 2 during the the washing and sterilization operations.

From FIG. 6 it will be seen that, before the commencement of each operating cycle, the machine is arranged fop washing and sterilization in the following way. The turret 1 is stopped, while the shaft 18 is raised by an amount sufficent to separate the upper disc 17 from the lower disc 2 as shown in FIG. 6, so that a space 47 is formed between the two discs and is completely sealed from the exterior by the contact of the seal 21 with the lower and non-enlarged part of the socket 22 and by the contact of the seal 24 with the upper non-tapered part of the disc 2. In these conditions, detergent and sanitizing fluids pass through the whole feeding circuit of the machine to completely clean and sterilize the said circuit.

Description of Some Other Embodiments of the Invention

Figure 8:
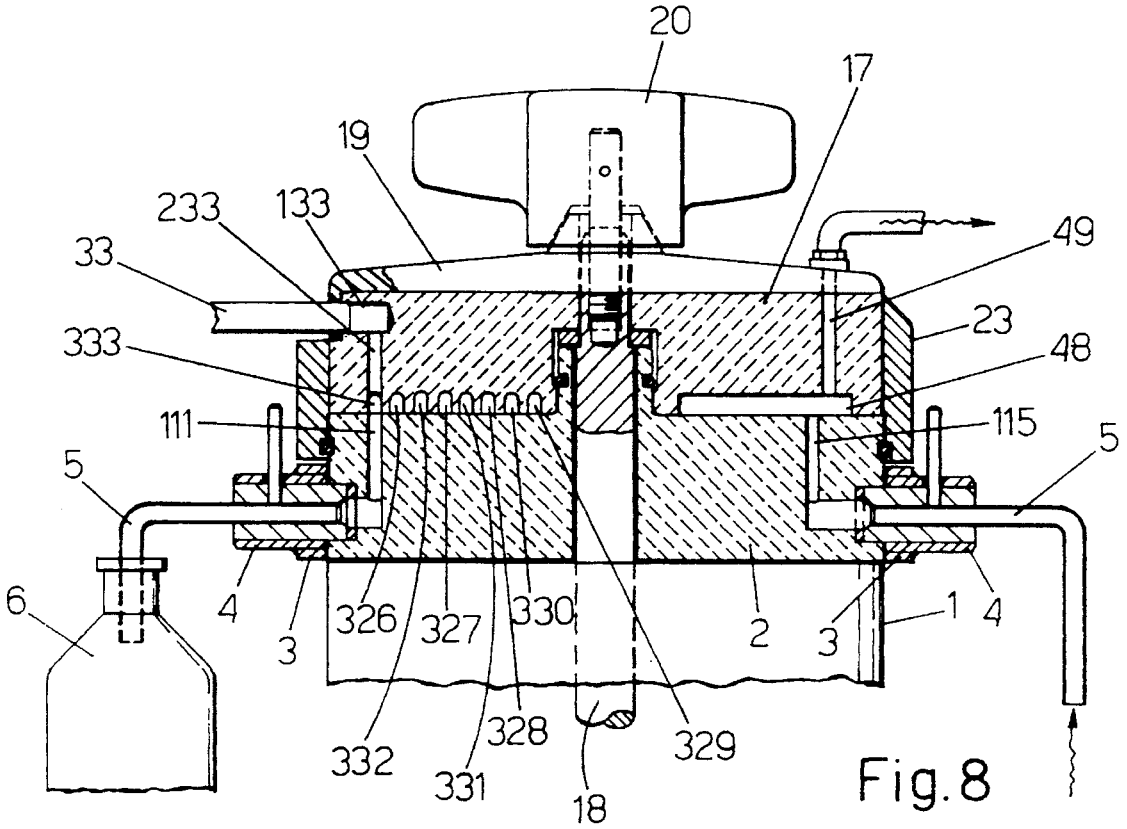
FIG. 8 shows other details of the variant of FIG. 7, sectioned along the line VIII—VIII of FIG. 7.
Figure 7:
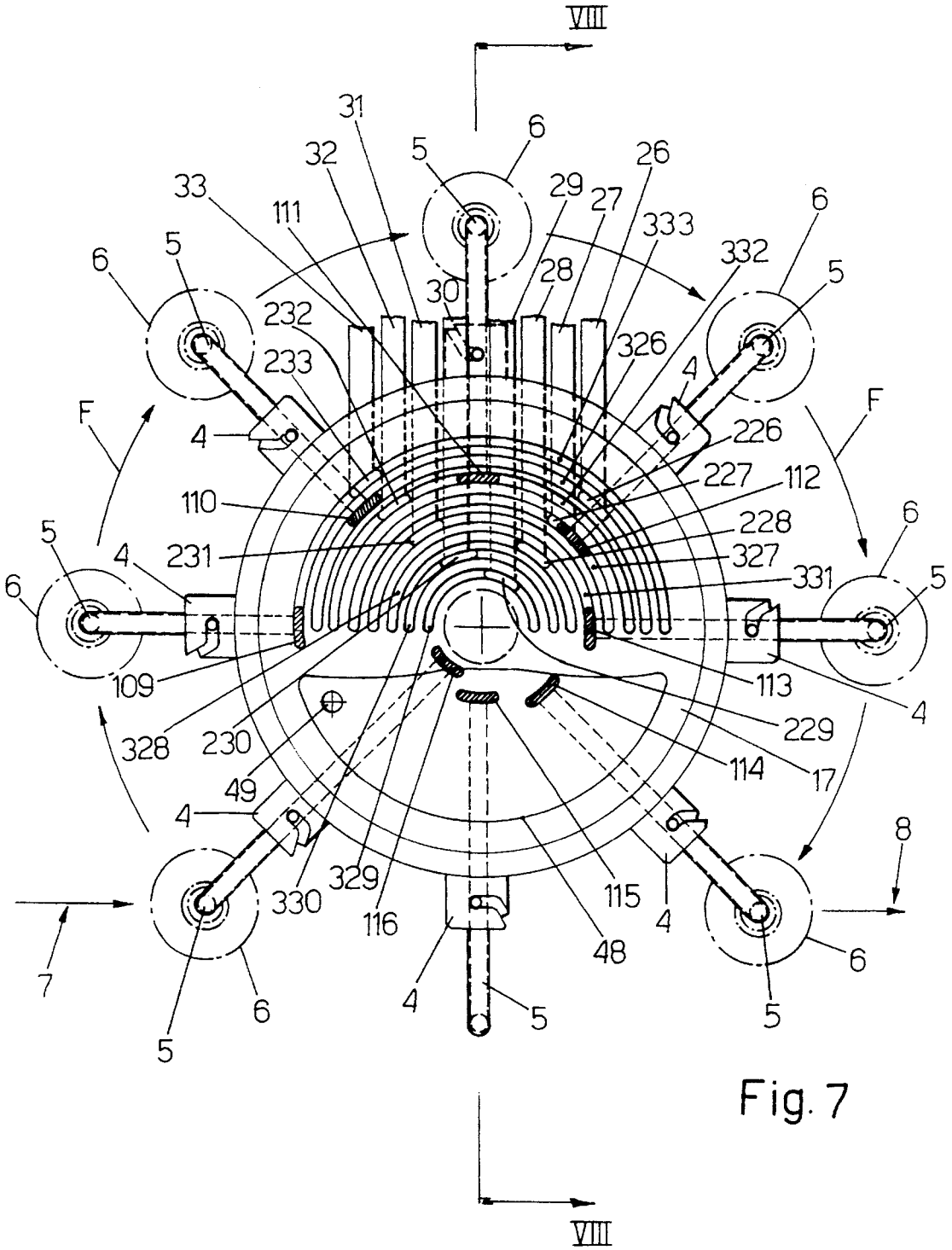
FIG. 7 is a partially sectioned plan view of a variant embodiment of the machine.
Figure 10:
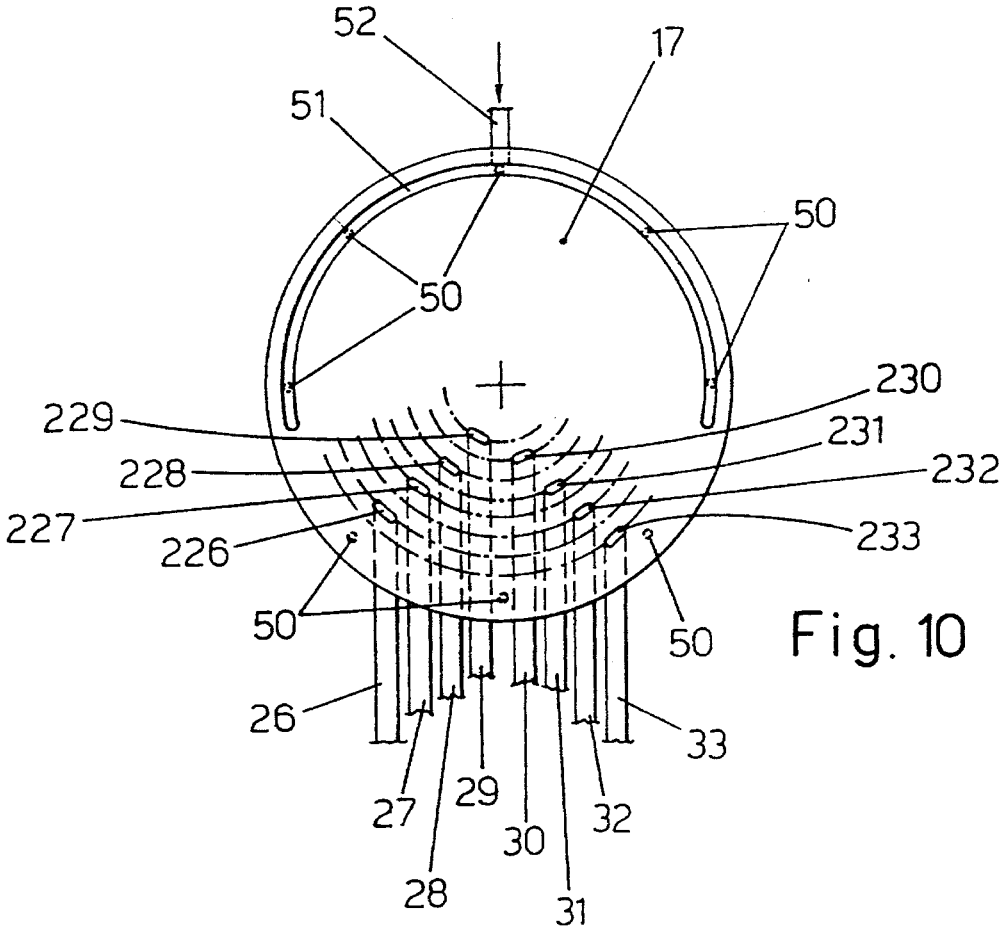
FIG. 10 shows further constructional details of the variant in FIG. 9 in section along the line X—X.
Figure 9:
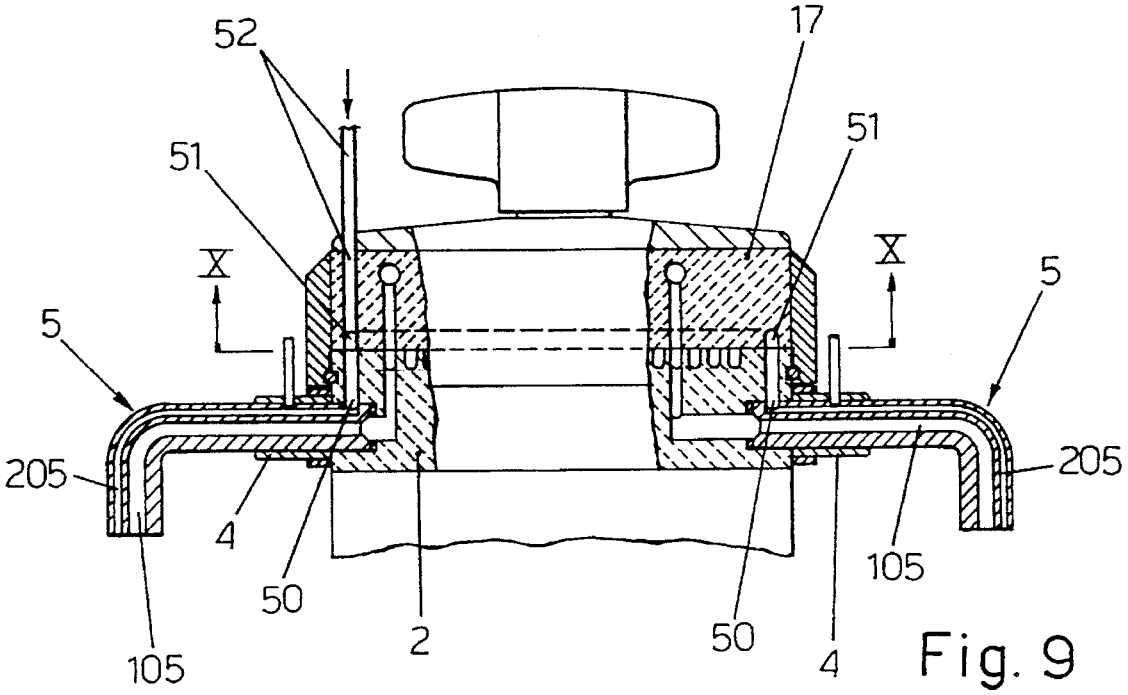
FIG. 9 shows a further constructional variant embodiment of the principal component of the machine in section as in FIGS. 2 or 8.

The variant in FIGS. 7 and 8 shows that the rotary joint formed by the discs 2 and 17 can be made to form a distribution chamber which connects the nozzles 5 to the feed circuits of the portions of product, only over a part of the round angle. From these figures it will be seen that the circuit connected to the nozzles 5 terminates on the upper face of the disc 2 with only the vertical holes 109-110-111-112-113-114-115-116 shown by hatching in FIG. 7. The vertical holes 226 to 233, which open on the lower face of the fixed disc 17 and connected to the corresponding product feed ducts 26 to 33, communicate with concentric channels 326 to 333 which open on the lower face of the said disc 2 and have the shape off a circular sector and a size such that they cover, for example, approximately 180° of this disc. When the holes 109 to 116 in the rotating disc 2 pass over the channels 326 to 333, the nozzles 5 are connected to the metered volume feeders and receive from them the portion of product to be introduced into the containers 6. The holes 109 to 116 which depart from the channels 326 to 333 can interact with closed parts of the lower face of the fixed disc 17 so that they are isolated from the feeders which are switched to the suction stage to form the next portion of product or, as illustrated in the example in FIGS. 7 and 8, the said holes 109 to 116 may interact with a recess 48 opening on the lower face of the fixed disc 17 and connected at hole 49 to a suction source which exerts its effect on the nozzles 5 when they are in their inoperative passage, in order to prevent the dripping of product from the nozzles. The variant shown in FIGS. 9 and 10 is based on the preceding variant and demonstrates the possibility of blowing into the containers 6, during the interaction with the product portion feeding carousel, an inert gas and/or one having characteristics promoting the preservation of the packaged product. In this case, the nozzles 5 have, in addition to the product conveying channel 105, corresponding longitudinal gas supply channels 205, meeting the same number of holes 50 opening on to the upper face of the rotating disc 2, disposed for example on the periphery of this disc and located on an ideal circumference which has its center in the axis of rotation of the rotary joint. In the course of the movement in which the nozzles 5 interact with the containers 6 for the introduction of the portions of product into them, the holes 50, indicated by broken lines in FIG. 10, interact in their turn with a channel 51 in the form of a sector of a circle, which also has its center in the axis of the rotary joint, opens on the lower face of the fixed disc 17, covers, for example, approximately 180° of the disc, and is connected to at least one sanitizing gas delivery duct 52.

Figure 11:
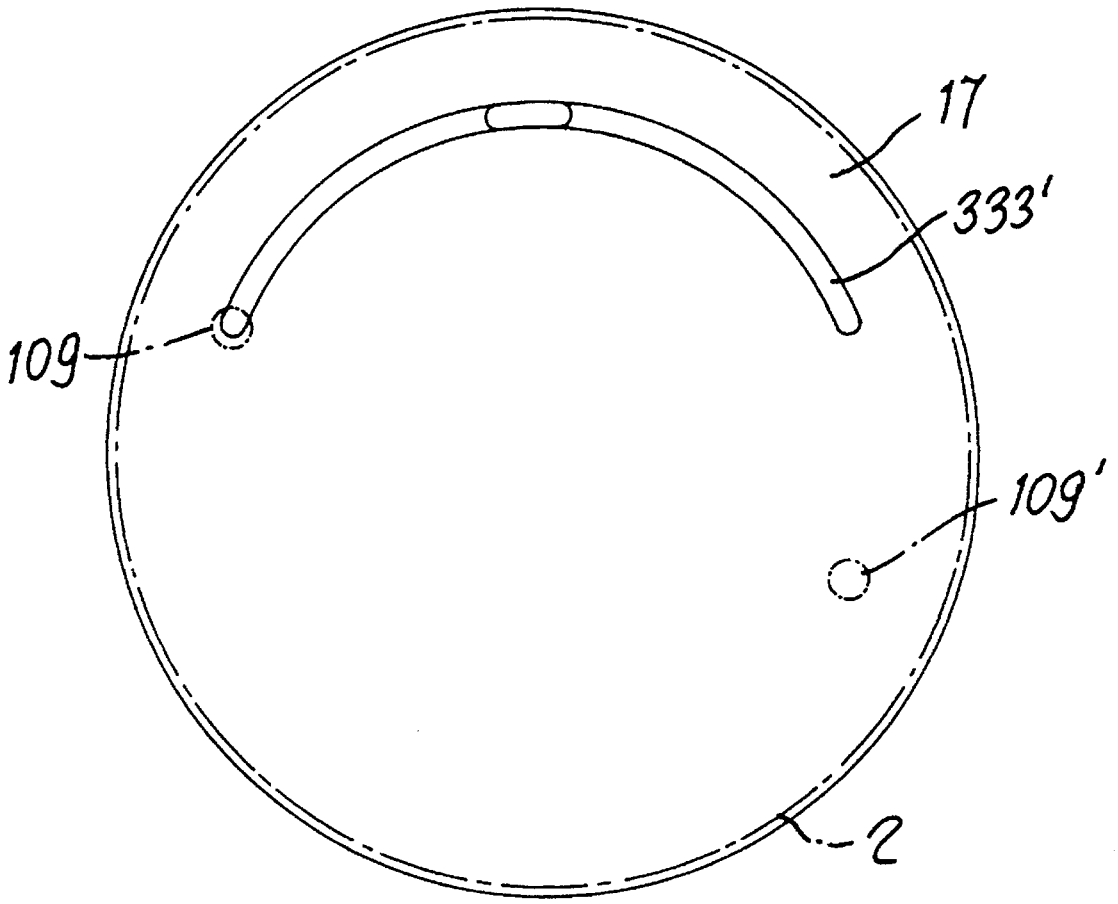
FIG. 11 shows in plan view a detail of a variant of the embodiment shown in FIGS. 7 and 8.

It is to be understood that the foregoing description refers to certain preferred embodiments of the invention, to which numerous modifications may be made without thereby departing from the principle of the invention. For instance, according to the embodiment shown diagrammatically in FIG. 11, the concentric channels formed in the fixed disc 17, and of which only one is shown at 333' in FIG. 11, are extended by an angle minor than 180°, and for instance by an angle of 140°. Thanks to the said feature, it will be possible to double the vertical holes 109 to 116 connected to the distribution nozzles and formed on the disc 2, since it will be possible to provide a second hole 109' (to 116') at a position diametrically opposed, that is offset by 180° on the disc 2 with respect to the first hole 109. The said pairs of holes 109 and 109' (but 110—110';111—111' . . . 116—116') will cooperate in successive times with the corresponding channels 326' to 333' extending by 140°.

We claim:

1. An automatic machine for the metered feeding and packaging of fluid products, comprising a carousel;

at least one rotary joint coaxial with said carousel, said joint being provided with a first part which rotates with the carousel and a second part fixed with respect to the carousel;

a plurality of product feed nozzles fixedly connected to said first part of said joint for feeding a metered amount of product into suitable containers;

a set of metered volume feeders which are stationary relative to said fixed second part;

valve means for controlling flow into and out of each of said volume feeders of said set which are stationary relative to said fixed second part;

a plurality of fixed ducts connecting said fixed second part to said set of metered volume feeders through said valve means;

a supply reservoir of the product to be fed fluidly connected to said feeders which are stationary relative to said fixed second part; and means for synchronizing the rotation of the carousel with a sequence of operation of the metered volume feeders and the corresponding valve means so that, through said rotary joint, the metered volume feeders are caused to be fluidly connected with said product feed nozzles of the carousel in a stage of discharge of the portion of product into the containers and to be isolated from said nozzles and fluidly connected to the supply reservoir at a stage in which a subsequent portion of product is drawn from the supply reservoir.

2. A machine according to claim 1, in which said carousel is provided with a rotating turret, and in which said rotary joint is formed by an upper fixed disc and a lower rotating disc with said upper disc overlying said lower disc, the lower disc, forming said first part of the joint, being secured to said turret of the carousel so as to rotate with said turret and being provided with said product feed nozzles in the form of a plurality of radially outwardly projecting, angularly equispaced nozzles which interact with the containers to be filled to introduce the portion of product into the containers, said nozzles being connected by corresponding holes to apertures formed on the upper face of said lower disc and communicating, at least for the period necessary for the discharge of the product into the containers, with corresponding apertures formed in a lower face of the upper disc of said joint, and said upper disc, forming said second part of said rotary joint, being connected to said plurality of fixed ducts, said metered volume feeders having a suction stage during which said metered volume feeders are filled with product from said product reservoir and a delivery stage during which said metered volume feeders are connected to said rotary joint, said valve means being controlled so as to switch at the precise moment when the feeders move from the suction to the delivery stage for connection respectively from said reservoir to the respective feed circuits passing through said rotary joint.

3. A machine according to claim 2, in which the upper face of the lower rotating disc of the rotary joint is provided with a plurality of open concentric circular channels suitably spaced apart in the proportion of at least one channel for each nozzle and with centers of said circular channels coinciding with an axis of rotation of the lower disc, and in which the lower face of the upper fixed disc of said joint is provided with a plurality of open holes with at least one respective said hole connecting a respective said fixed duct with a respective said circular channel.

4. A machine according to claim 2, in which the upper face of the lower rotating disc of the rotary joint has open holes in the proportion of one open hole for each product feed nozzle disposed in separate concentric tracks located about an axis of rotation of said turret, and in which the lower face of the fixed upper disc of said joint has a plurality of curved concentric channels formed thereon which respectively communicate during the rotation of the carousel with a respective open hole, each said channel being connectable to a corresponding said fixed duct and having an angular extent sufficient to permit connection to a respective said nozzle for the introduction of the portion of product into the container which rotates on the carousel over a portion of the rotation of said carousel.

5. A machine according to claim 4, in which said concentric curved channels extend from an angle of less than 180°, and said open holes are doubled by providing for each of said holes a diametrically opposed simmetric hole on the lower rotating disc.

6. A machine according to claim 2, in which each product feed nozzle is provided with at least one supplementary longitudinal channel to blow gas into the containers for packaging the portions of product, said channels meeting respective holes which open on the upper face of the lower disc of the rotary joint and which said holes, when the nozzles interact with corresponding containers, communicate with a curved channel opening on the lower face of the upper disc of said rotary joint connected in turn by at least one duct to a gas supply source.

7. A machine according to claim 2, in which a top of the lower disc of the rotary joint is provided with an axial projection having a lateral seal, in which a corresponding coaxial socket in the upper disc receives said axial projection and in turn carries on a circumference thereof an integral ring which with an internal annular seal interacts with the outer lateral surface of the lower disc of the joint, and in which a displacement means is provided for enabling a relative axial displacement to be imparted to the two discs of the joint, the displacement being sufficient to form, between the opposing faces of the discs, a space which, by means of said seals, is sealed with respect to the exterior and in which a liquid for washing and sterilizing of the machine can circular so that the machine is made ready for a new operating cycle.

8. A machine according to claim 7, characterized in that when the two discs of the rotary joint are in contact with each other and in an active operating position, the annular seals providing the seal during the washing and sterilizing are spaced from recessed parts of the opposing surfaces so that the annular seals are not touched by the recessed parts and so that friction which might damage said seals is avoided.

9. A machine according to claim 7, in which the upper fixed disc of the rotary joint is integral with an axial shaft associated with said displacement means whose movement can lower and raise said upper fixed disc to bring the joint between the operating position and a position for washing and sterilization respectively.

10. A machine according to claim 2, in which said upper and lower discs are formed of a ceramic material.

11. A machine according to claim 2, in which over a remainder of the rotation of said carousel said holes interact with closed parts of the upper disc to prevent a dripping of the product from the nozzles as the nozzles leave a just filled container and move towards a next container.

12. A machine according to claim 11, in which the angular extent is about 140°.

13. A machine according to claim 2, in which over a remainder of the rotation of said carousel said holes interact with a chamber connected to a suction means to prevent a dripping of the product from the nozzles as the nozzles leave a just filled container and move towards a next container.

* * * * *